US010355406B2

(12) United States Patent
Joniak et al.

(10) Patent No.: US 10,355,406 B2
(45) Date of Patent: Jul. 16, 2019

(54) ELECTRICAL CONNECTOR

(71) Applicant: Molex, LLC, Lisle, IL (US)

(72) Inventors: Jeffrey Joniak, Homer Glen, IL (US); Ronald C. Hodge, Aurora, IL (US); Joseph D. Comerci, Elmhurst, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/078,934

(22) PCT Filed: Feb. 21, 2017

(86) PCT No.: PCT/US2017/018689

§ 371 (c)(1),
(2) Date: Aug. 22, 2018

(87) PCT Pub. No.: WO2017/147062

PCT Pub. Date: Aug. 31, 2017

(65) Prior Publication Data

US 2019/0058284 A1 Feb. 21, 2019

Related U.S. Application Data

(60) Provisional application No. 62/299,861, filed on Feb. 25, 2016.

(51) Int. Cl.
*H01R 13/62* (2006.01)
*H01R 13/627* (2006.01)
(Continued)

(52) U.S. Cl.
CPC ..... *H01R 13/6272* (2013.01); *H01R 13/436* (2013.01); *H01R 13/622* (2013.01);
(Continued)

(58) Field of Classification Search
CPC ..... H01R 13/625; H01R 13/623; H01R 17/005; H01R 85/542; H01R 33/46
(Continued)

(56) References Cited

U.S. PATENT DOCUMENTS 6,226,068 B1 * 5/2001 Arcykiewicz ..... H01R 13/625 439/314
6,290,525 B1 * 9/2001 Jacobi ..... H01R 13/6277 439/310
(Continued)

FOREIGN PATENT DOCUMENTS

CN 1941517 A 4/2007
CN 202840096 U 3/2013
(Continued)

*Primary Examiner* — Phuong Chi T Nguyen
(74) *Attorney, Agent, or Firm* — Molex, LLC

(57) ABSTRACT

A connector system according to some embodiments of the disclosure includes first and second connectors. Each connector includes a housing, a terminal retainer having electrical terminals that are connected to a cable mounted therein. The housings are configured to mate together. One connector includes a locking protrusion on the housing, a first sleeve which is moveable relative to the housing, a second sleeve attached to the first sleeve and which is moveable relative to the first sleeve and relative to the housing, and a biasing member mounted between the first housing and the second sleeve. The biasing member is configured to bias the first and second sleeves toward a mating end. The housing of the second connector has a flexible finger configured to cause movement of the second sleeve relative to the first sleeve and further configured to releasably engage the locking protrusion on the first housing.

16 Claims, 19 Drawing Sheets

(51) Int. Cl.

| | |
|---|---|
| ***H01R 13/622*** | (2006.01) |
| ***H01R 24/86*** | (2011.01) |
| ***H01R 13/436*** | (2006.01) |
| *H01R 107/00* | (2006.01) |

(52) U.S. Cl.
CPC ..... *H01R 13/6277* (2013.01); *H01R 24/86* (2013.01); *H01R 2107/00* (2013.01)

(58) Field of Classification Search
USPC ..... 439/314, 319, 332, 335–336
See application file for complete search history.

(56) References Cited

U.S. PATENT DOCUMENTS

| | | | | |
|---|---|---|---|---|
| 6,364,681 | B1 * | 4/2002 | Watanabe | H01R 13/625 439/335 |
| 6,561,841 | B2 * | 5/2003 | Norwood | H01R 13/625 439/286 |
| 6,568,949 | B1 * | 5/2003 | Walters | H01R 13/5202 439/319 |
| 6,942,516 | B2 | 9/2005 | Shimoyama et al. | |
| 7,081,001 | B1 | 7/2006 | Conroy et al. | |
| 7,435,112 | B1 * | 10/2008 | Miller | H01R 13/502 439/133 |
| 7,452,228 | B1 * | 11/2008 | Kennedy | H01R 13/622 439/314 |
| 2006/0046566 | A1 | 3/2006 | Zemba | |
| 2014/0065874 | A1 | 3/2014 | Ledgerwood et al. | |
| 2015/0222050 | A1 | 8/2015 | Behning | |

FOREIGN PATENT DOCUMENTS

| | | | |
|---|---|---|---|
| CN | 103618171 | A | 3/2014 |
| CN | 204992111 | U | 1/2016 |
| WO | WO 2010-042579 | A2 | 4/2010 |

* cited by examiner

ELECTRICAL CONNECTOR

RELATED APPLICATIONS

This application is a national stage of International Application No. PCT/US2017/018689, filed Feb. 21, 2017, which claims the priority of U.S. Ser. No. 62/299,861, filed on Feb. 25, 2016, both of which are incorporated herein by reference in their entirety.

FIELD OF THE DISCLOSURE

The disclosure relates to the field of connectors, more specifically to the field of connectors with a push-on type latching mechanism.

DESCRIPTION OF RELATED ART

Today traditional connectors are used in the medical industry and involve a quick-connect device. These types of connectors generally have a spring biased locking ring that secures a plug and receptacle together. The locking ring prevents the connectors from inadvertently becoming unmated.

The operation of these locking devices typically involves a retractable collar, a biasing element and a blocking member wherein the blocking member prevents the connectors from becoming uncoupled. In operation, the collar which is connected to the blocking member is retracted against the biasing member upon which the blocking member is moved to a position where the latching mechanism is no longer blocked from disengaging. In this instance, the connectors can be either mated or un-mated by pushing the connectors together or pulling the connectors apart. In both of these situations, the collar must be retracted in order to perform the mating or un-mating.

SUMMARY

In an embodiment, a connector system is disclosed that includes a first connector and a second connector. The connectors include a terminal retainer having a plurality of electrical terminals that are connected to a cable having a corresponding number of lead wires connected to respective terminals. Each terminal retainer is disposed in a housing that are configured to mate together. One of the connectors includes a locking protrusion on the housing, a first sleeve mounted on the housing which is moveable relative to the housing, a second sleeve mounted on the housing and attached to the first sleeve, the second sleeve being moveable relative to the first sleeve and relative to the housing, and a biasing member mounted between the first housing and the second sleeve. The biasing member is configured to bias the first and second sleeves toward the front mating end. The housing of the second connector has a flexible finger which is configured to cause movement of the second sleeve relative to the first sleeve and is further configured to releasably engage the locking protrusion on the first housing.

BRIEF DESCRIPTION OF THE DRAWINGS

The disclosure is illustrated by way of example and not limited in the accompanying figures in which like reference numerals indicate similar elements and in which.

DETAILED DESCRIPTION

Figure 1:
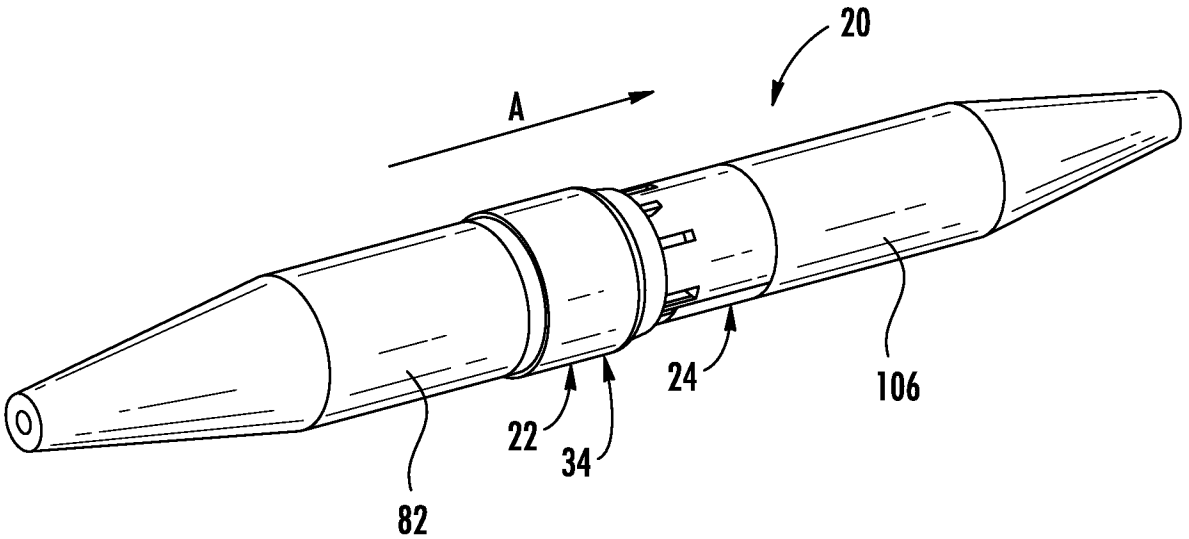
FIG. 1 is a perspective view of a connector system which incorporates the features of the present disclosure.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Figure 32:
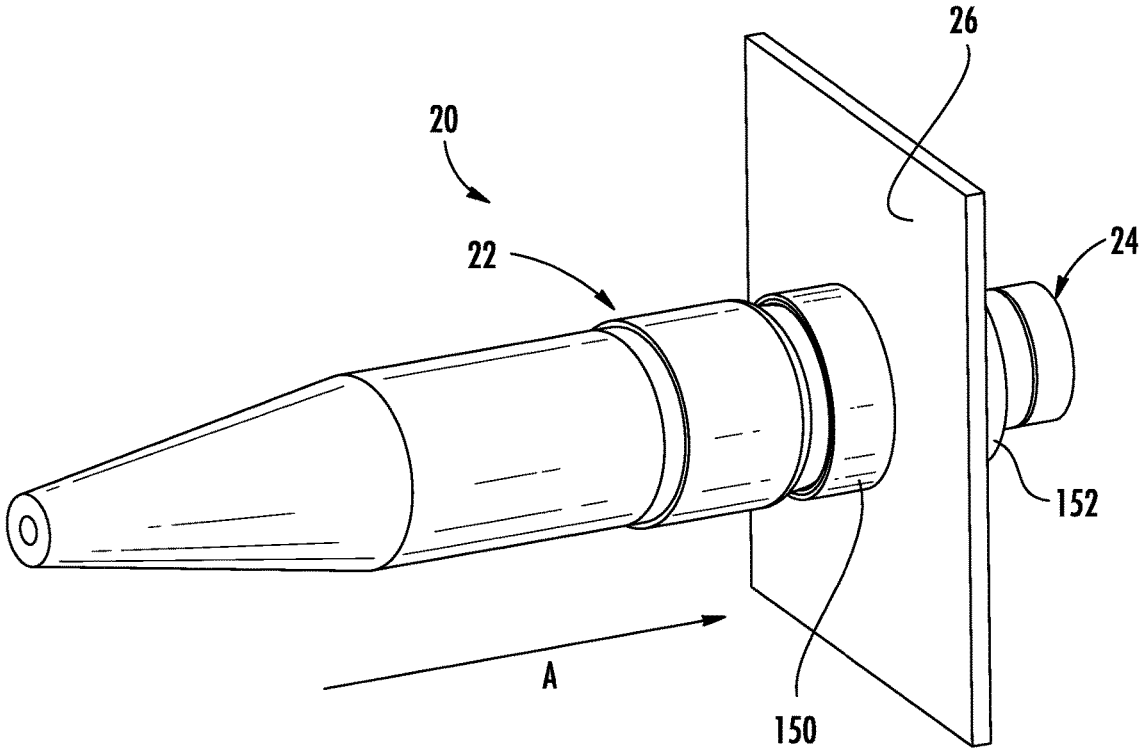
FIG. 32 is a rear perspective view showing the first and second connectors mounted to the panel.

A connector system 20 is provided and includes a first connector 22 and a second connector 24 which are mated together. In an embodiment, the first connector 22 is a plug connector and the second connector 24 is a receptacle connector. The embodiment shown in FIG. 1 is an inline connector system, and the embodiment shown in FIG. 32 is a panel mount connector system. In the panel mount connector system, the second connector 24 is mounted to a panel 26. Each connector 22, 24 is mounted at the end of a multi-conductor cable (not shown).

Figure 2:
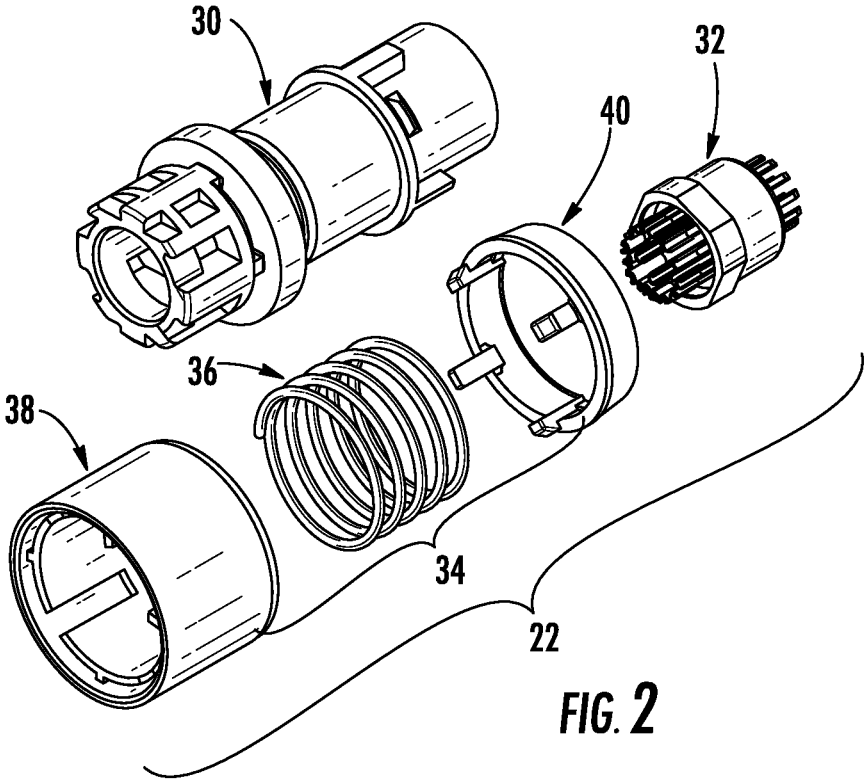
FIG. 2 is an exploded rear perspective view of an embodiment of a first connector of the connector system.

As shown in FIG. 2, the first connector 22 includes a housing 30, a terminal retainer 32 mounted in the housing 30, a sleeve assembly 34 mounted on the housing 30, and biasing member 36 engaged between the housing 30 and the sleeve assembly 34. The sleeve assembly 34 includes a first sleeve 38 and a second sleeve 40 attached to the first sleeve 38. The first sleeve 38 is configured to move relative to the housing 30. The second sleeve 40 is configured to move relative to the first sleeve 38 and relative to the housing 30.

Figure 3:
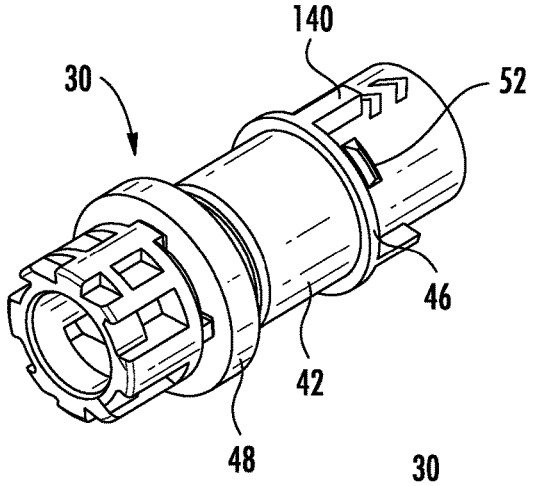
FIG. 3 is a rear perspective view of an embodiment of a housing of the first connector.
Figure 4:
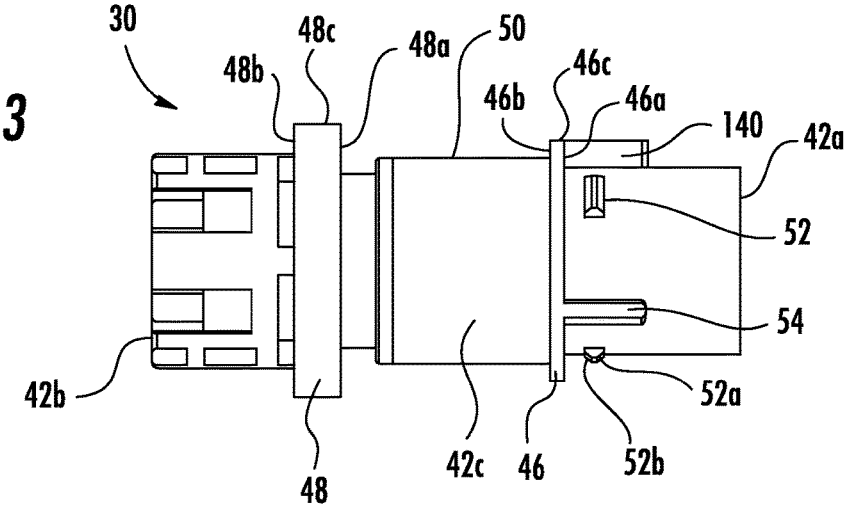
FIG. 4 is a side elevation view of the housing of FIG. 3.
Figure 5:
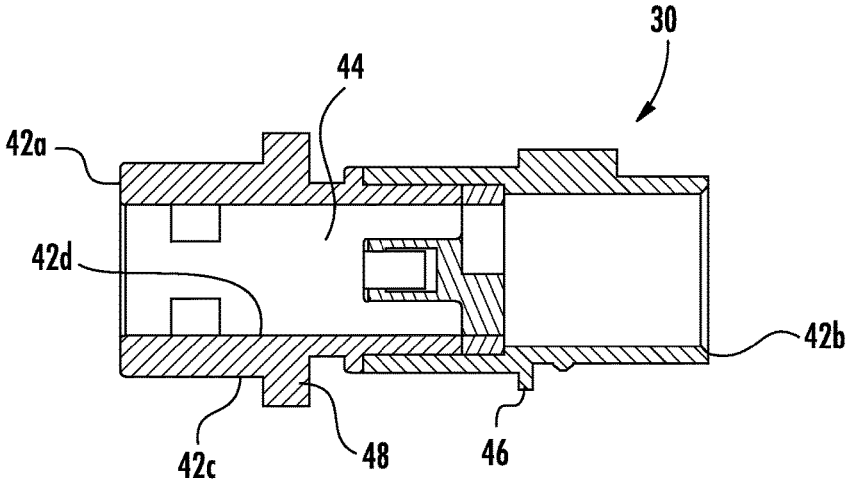
FIG. 5 is a cross-sectional view of the housing of FIG. 3.

The housing 30, see FIGS. 3-5, is formed from a wall 42 having a front mating end 42*a* and an opposite rear end 42*b*, an outer surface 42*c*, and an inner surface 42*d* defining a central passageway 44 which extends from the front end 42*a* to the rear end 42*b*. A forward flange 46 extends outwardly from the outer surface 42*c* of the wall 42, and a rearward flange 48 extends outwardly from the outer surface 42*c* of the wall 42. The forward flange 46 has a forward surface 46*a*, a rearward surface 46*b* and an outer surface 46*c*. The rearward flange 48 has a forward surface 48*a*, a rearward surface 48*b* and an outer surface 48*c*. The forward and rearward flanges 46, 48 are spaced apart from each other to define a first sleeve and biasing member receiving space 50 therebetween. At least one locking protrusion 52 extends outwardly from the outer surface 42*c* of the wall 42 and is provided between the forward flange 46 and the front end 42*a* of the wall 42 of the housing 30. In an embodiment, a plurality of spaced apart locking protrusions 52 are provided. In an embodiment, a single locking protrusion 52 is provided and extends around the circumference or partially around the circumference of the wall 42. The protrusions or protrusion 52 has a front surface 52*a* which angles outwardly from the outer surface 42*c* of the wall 42 and rearwardly toward the rear end 42*b* of the wall 42, and a rear surface 52*b* which angles outwardly from the outer surface 42*c* of the wall 42 and forwardly toward the front end 42*a* of the wall 42.

In an embodiment, the wall 42 has a circular outer profile.

Figure 6:
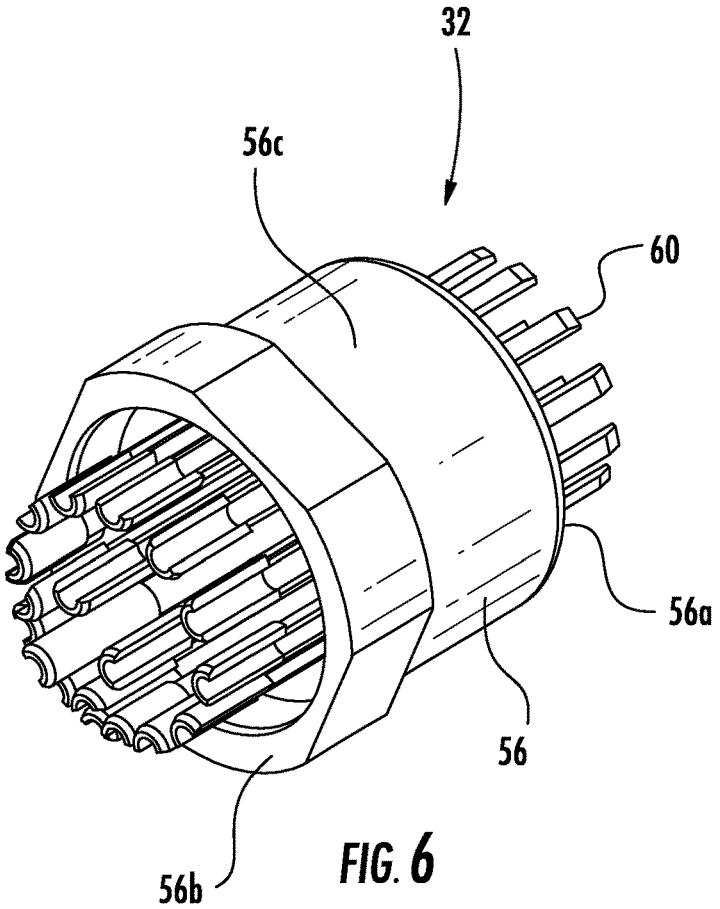
FIG. 6 is a rear perspective view of an embodiment of a terminal retainer of the first connector.
Figure 7:
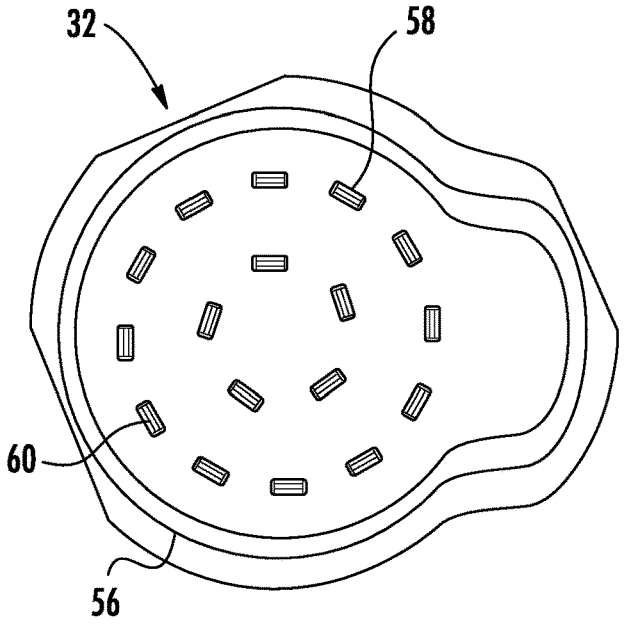
FIG. 7 is a front end elevation view of the terminal retainer of FIG. 6.
Figure 8:
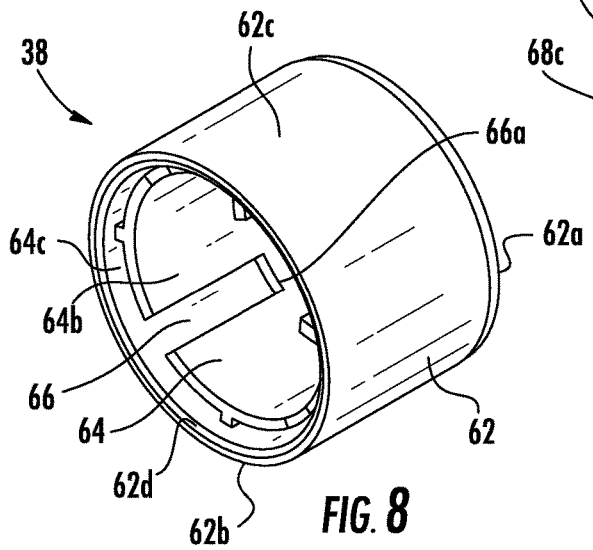
FIG. 8 is a rear perspective view of an embodiment of a first sleeve of the first connector.
Figure 9:
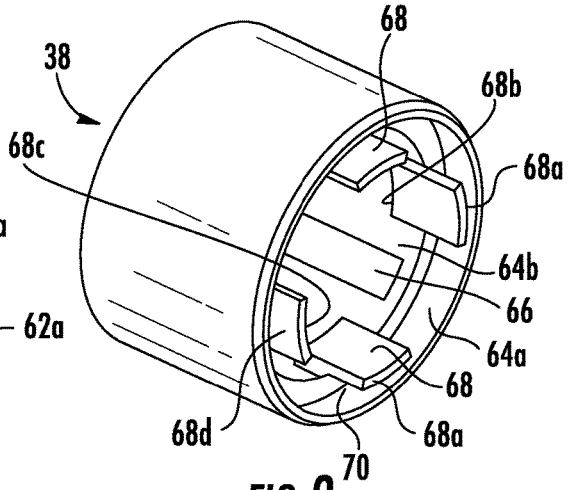
FIG. 9 is a front perspective view of an embodiment of the first sleeve of FIG. 9.
Figure 10:
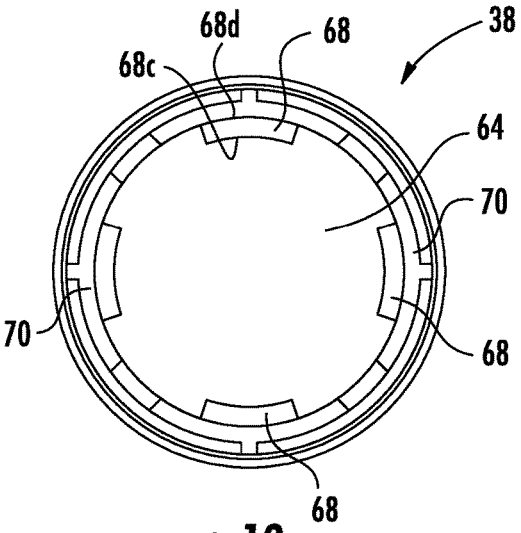
FIG. 10 is a front end elevation view of the first sleeve of FIG. 9.
Figure 11:
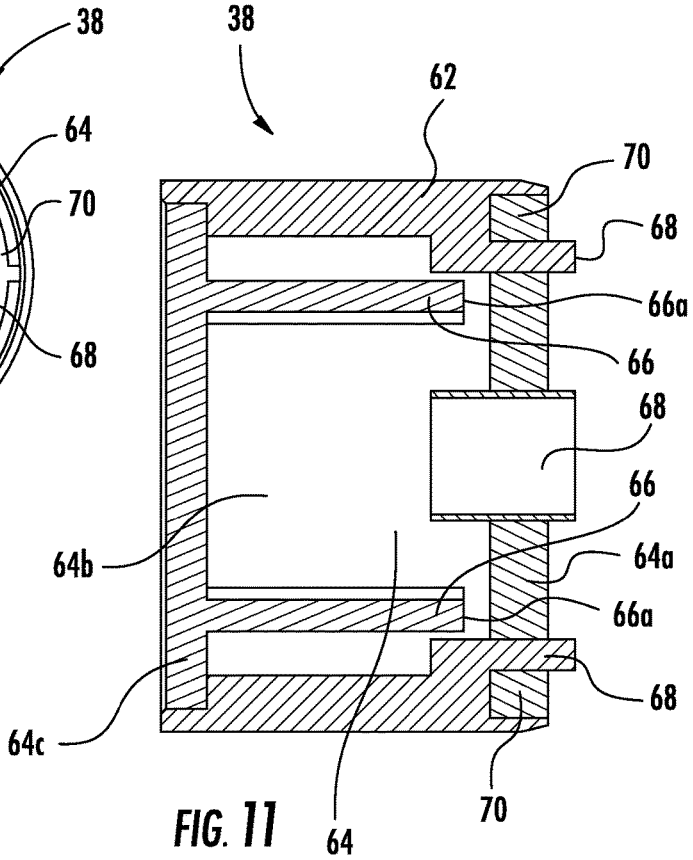
FIG. 11 is a cross-sectional view of the first sleeve of FIG. 9.

The terminal retainer 32, see FIGS. 6 and 7, has a wall 56 defining a front end 56*a* and an opposite rear end 56*b* and an outer surface 56*c*. A plurality of passageways 58 extend through the wall 56 and respective individual terminals 60 are secured within and extends through the respective passageways 58. Respective conductors of the cable (not shown) are electrically attached to the individual terminals 60. The terminal retainer 32 is mounted within the central passageway 44 of the housing 30 and secured to the inner surface 42*d* of the wall 42 of the housing 30.

As shown in FIGS. 8-11, the first sleeve 38 is formed from a wall 62 having a front end 62*a*, a rear end 62*b*, an outer surface 62*c*, an inner surface 62*d* defining a central passageway 64 which extends from the front end 62*a* to the rear end 62*b*. A front section of the inner surface 62*d* of the wall 62 defines a front section 64*a* of the passageway 64 which extends from the front end 62*a* of the wall 62 rearwardly; an intermediate portion of the wall 62 defines an intermediate section 64*b* of the passageway 64 which extends from the front section 64*a* rearwardly, and a rear portion of the wall 62 defines a rear section 64*c* of the passageway 64 which extends from the intermediate section 64*b* to the rear end 62*b* of the wall 62. The intermediate portion 64*b* defines an inner diameter which is less than an inner diameter defined by the front portion 64*a*. The inner diameter of the intermediate portion 64*b* is less than an inner diameter defined by the rear portion 64*c*. The intermediate portion of the wall 62 which defines the intermediate section 64*b* of the passageway 64 has a plurality of spaced apart elongated recesses 66 therein which extend from the rear section 64*c* of the passageway 64 forwardly toward the front end 62*a* of the wall 62. Each recess 66 terminates in a front end 66*a*. A plurality of blocks 68 extend from the intermediate portion of the wall 62 which defines the intermediate section 64*b* of the passageway 64, and overlap the front section 64*a* of the passageway 64. The blocks 68 are offset from the recesses 66 around the circumference of the first sleeve 38. Each block 68 has a forward end 68*a*, an opposite rearward end 68*b*, an inner surface 68*c* and an outer surface 68*d*. Second sleeve receiving spaces 70 are formed between the outer surfaces 68*d* of the blocks 68 and the inner surface of the front portion of the wall 62 which defines the front section 64*a* of the passageway 64.

Figure 12:
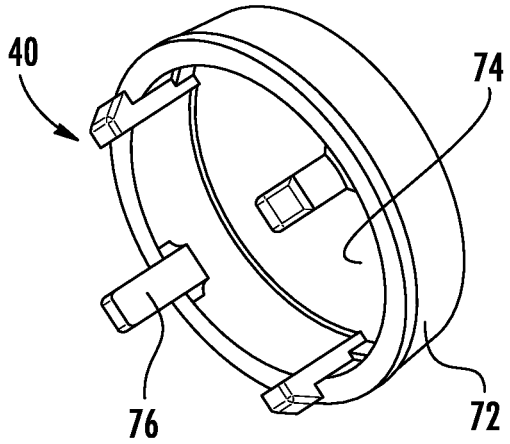
FIG. 12 is a rear perspective view of an embodiment of a second sleeve of the first connector.
Figure 13:
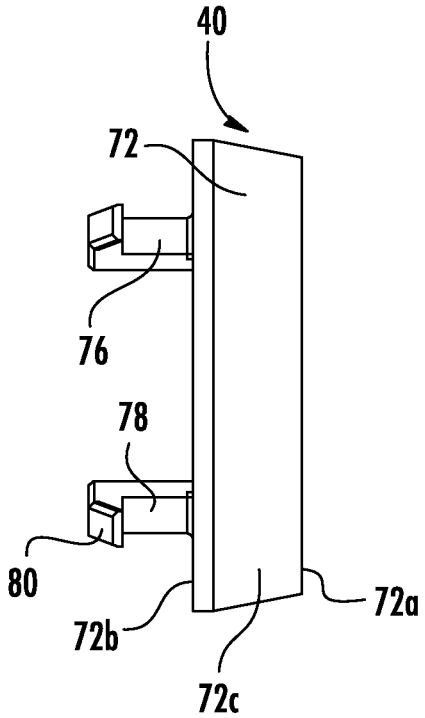
FIG. 13 is a side elevation view of an embodiment of the second sleeve of FIG. 12.
Figure 14:
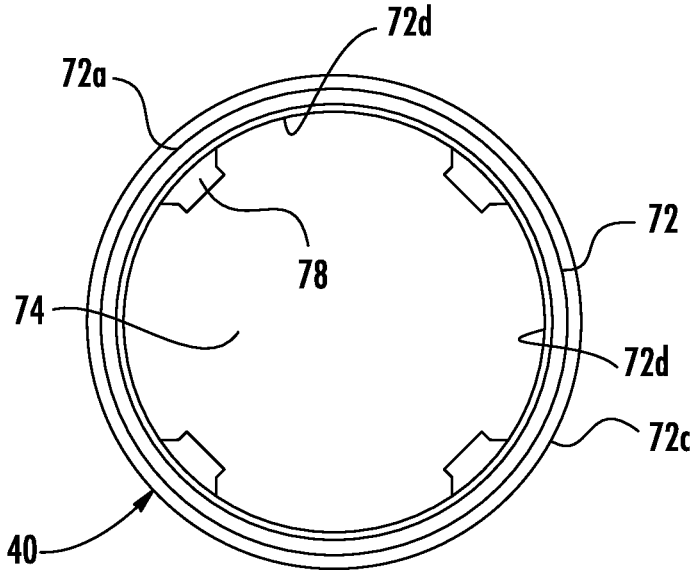
FIG. 14 is a front end elevation view of the second sleeve of FIG. 12.

The second sleeve 40, see FIGS. 12-14, is formed of a wall 72 having a front end 72*a*, an opposite rear end 72*b*, an outer surface 72*c*, and an inner surface 72*d* defining a central passageway 74 which extends from the front end 72*a* to the rear end 72*b*. A plurality of spaced apart latch arms 76 extend from the rear end 72*b* of the wall 72. Each latch arm 76 has a flexible body 78 which is attached to the inner surface 72*d* of the wall 72 and extends rearwardly therefrom, and a projection 80 at the free end. The projections 80 extend inwardly from the body 78. The outer surface 72*d* of the wall 72 may have a tapered section which extends from the front end 72*a* of the wall 72 rearwardly and a cylindrical section which extends from the rear end of the tapered section to the rear end 72*b* of the wall 72.

The biasing member 36 has a front end 36*a* and an opposite rear end 36*b*. In an embodiment, the biasing member 36 is a coil spring.

Figure 15:
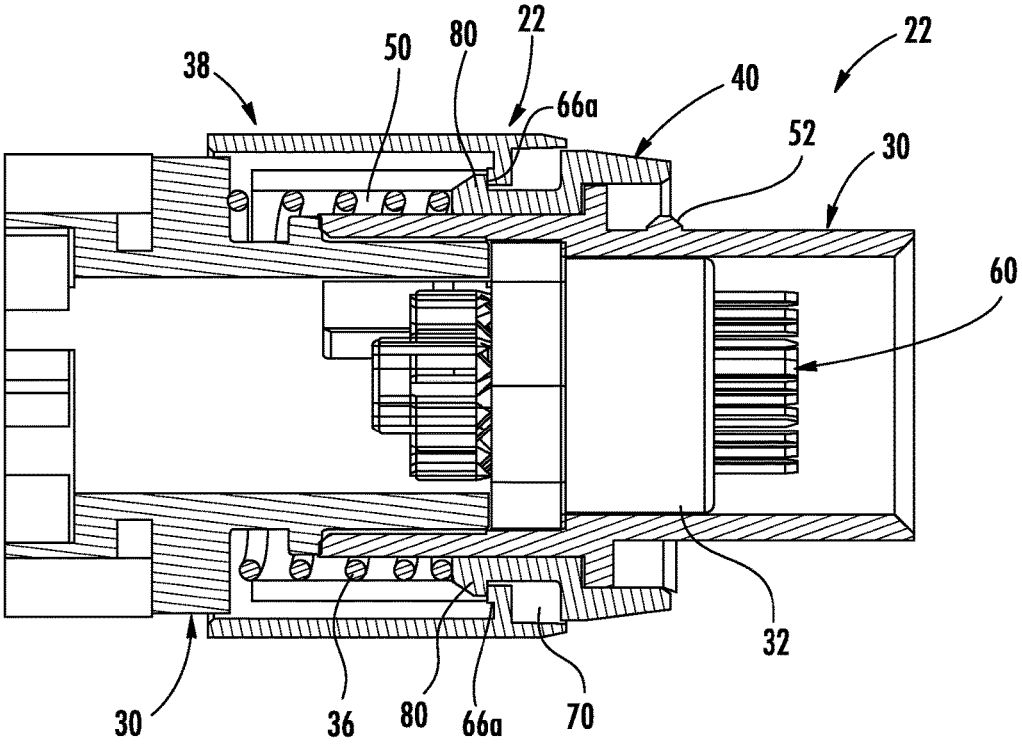
FIG. 15 is a partial cross-sectional view of the first connector.
Figure 20:
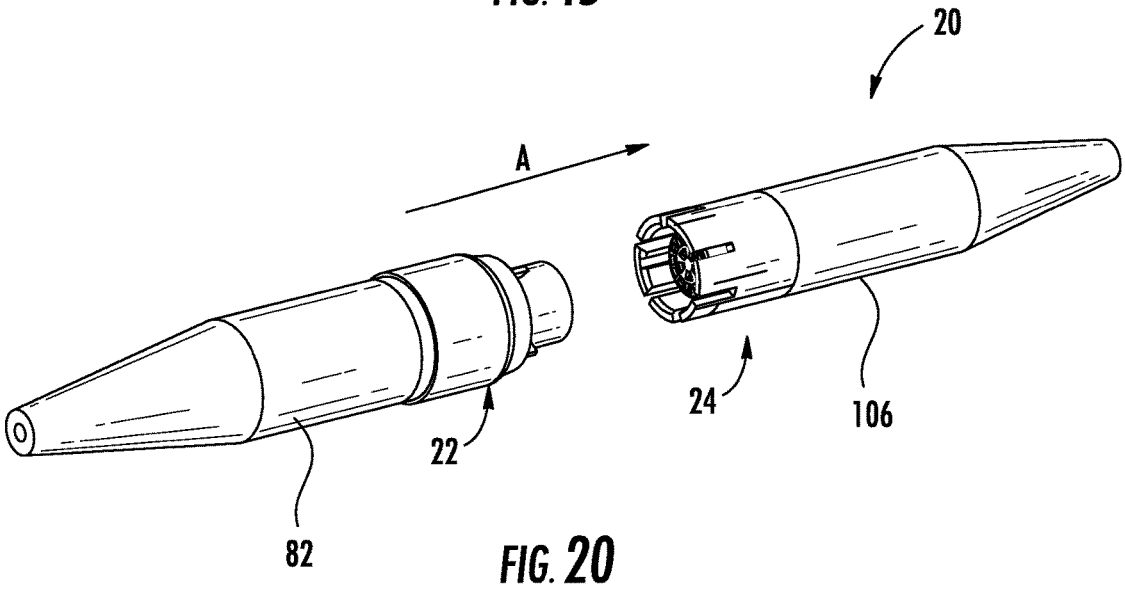
FIG. 20 is a perspective view of the first and second connectors in an unmated condition.
Figure 16:
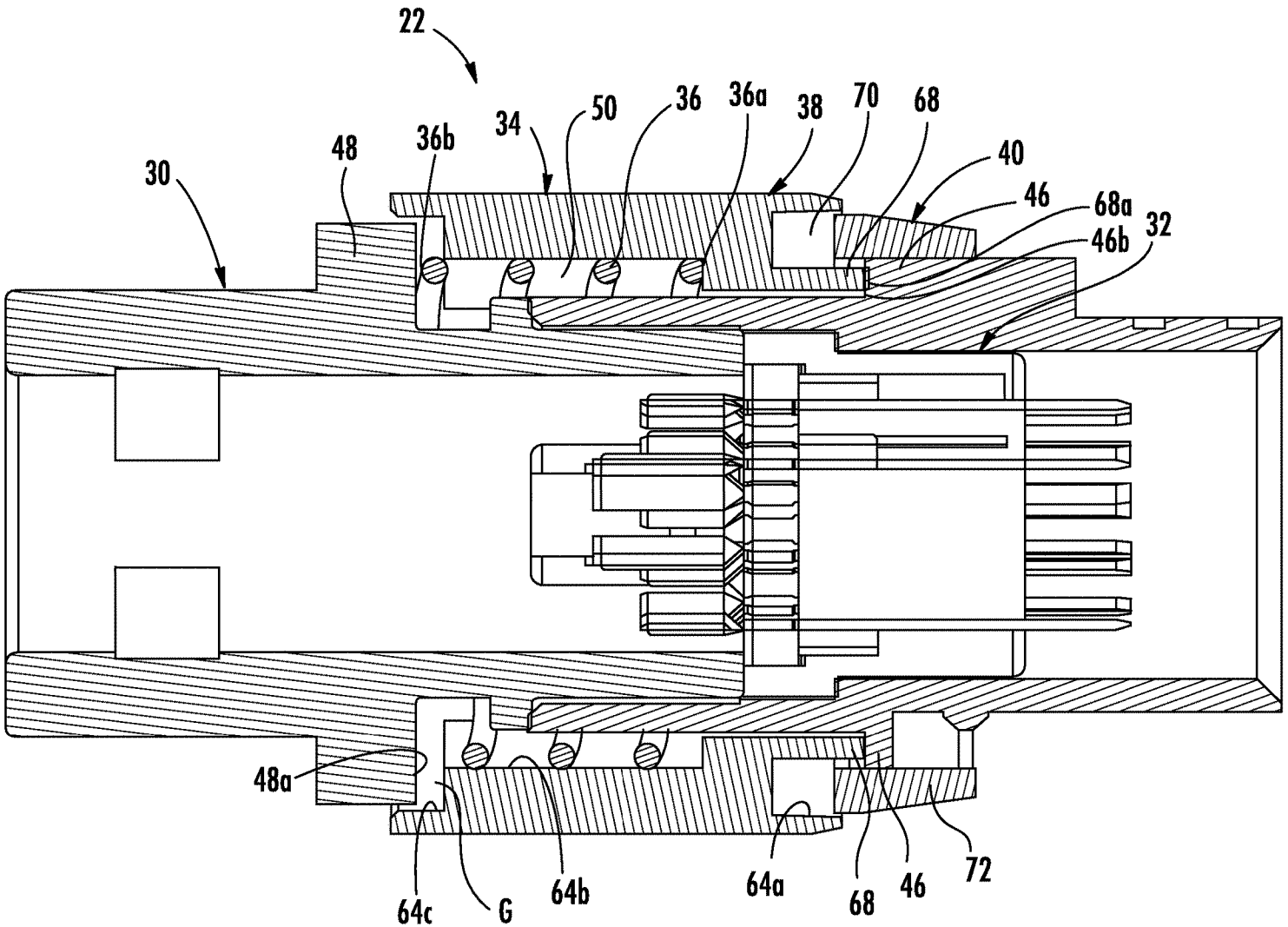
FIG. 16 is an alternate partial cross-sectional view of the first connector.

As assembled and as shown in FIGS. 15 and 16, the terminal retainer 32 is seated within the housing 30. The front portion of the wall 62 which defines the front section 64*a* of the passageway 64 and the intermediate portion of the wall 62 which defines the intermediate section 64*b* of the passageway 64 of the first sleeve 38 seat within the first sleeve and biasing member receiving space 50 in the housing 30. The blocks 68 seat within the first sleeve and biasing member receiving space 50 and the forward ends 68*a* of the blocks 68 abut against the rearward surface 46*b* of the forward flange 46 of the housing 30. The rear portion of the wall 62 which defines the rear section 64*c* of the passageway 64 of the first sleeve 38 at least partially overlaps the rearward flange 48. The rear end of the intermediate portion of the wall 62 which defines the intermediate section 64*b* of the passageway 64 is proximate to the forward surface 48*a* of the rearward flange 48 such that a gap G is formed between the first sleeve 38 and the housing 30. The biasing member 36 seats within the first sleeve and biasing member receiving space 50. The front end 36*a* of the biasing member 36 is configured to engage the protrusions 80 of the latch arms 76 and the rearward ends 68*a* of the blocks 68. The rear end 36*b* of the biasing member 36 is configured to engage the forward surface 48*a* of the rearward flange 48 of the housing 30. The wall 72 of the second sleeve 40 extends around and engages the forward flange 46 and seats at least partially within the second sleeve receiving spaces 70, the latch arms 76 extend between the blocks 68, and the projections 80 on the latch arms 76 seat within the elongated recesses 66 in the first sleeve 38. While four latch arms 76 and recesses 66 are shown, less or more than four latch arms 76 and recesses 66 may be provided. While four blocks 68 are shown, less or more than four blocks 68 may be provided.

In an unbiased condition as shown in FIGS. 15 and 16, the biasing member 36 is fully expanded and biases the projections 80 on the latch arms 76 of the second sleeve 40 into engagement with the front ends 66*a* of the elongated recesses 66 in the first sleeve 38. The second sleeve 40 can be biased rearwardly to move the second sleeve 40 relative to the first sleeve 38 as described herein. During this movement, the projections 80 on the latch arms 76 of the second sleeve 40 slide rearwardly along the elongated recesses 66 of the first sleeve 38, the wall 72 of the second sleeve 40 slides rearwardly along the forward flange 46 and along the second sleeve receiving spaces 70 of the first sleeve 38. When the second sleeve 40 is biased rearwardly, the biasing member 36 is compressed between the latch arms 76 of the second sleeve 40 and the rearward flange 48 of the housing 30. When the second sleeve 40 is no longer biased rearwardly, the biasing member 36 expands and the projections 80 on the latch arms 76 of the second sleeve 40 slide forwardly along the elongated recesses 66 until the projections 80 contact the front ends 66*a* of the recesses 66, the wall 72 of the second sleeve 40 slides forwardly along the second sleeve receiving spaces 70 of the first sleeve 38 and along the forward flange 46.

In an embodiment, a strain relief member 82, FIG. 1, is retained to the housing 30 to provide added cable retention to the connector system 20 to provide resistance to damaging cable pullout.

Figure 17:
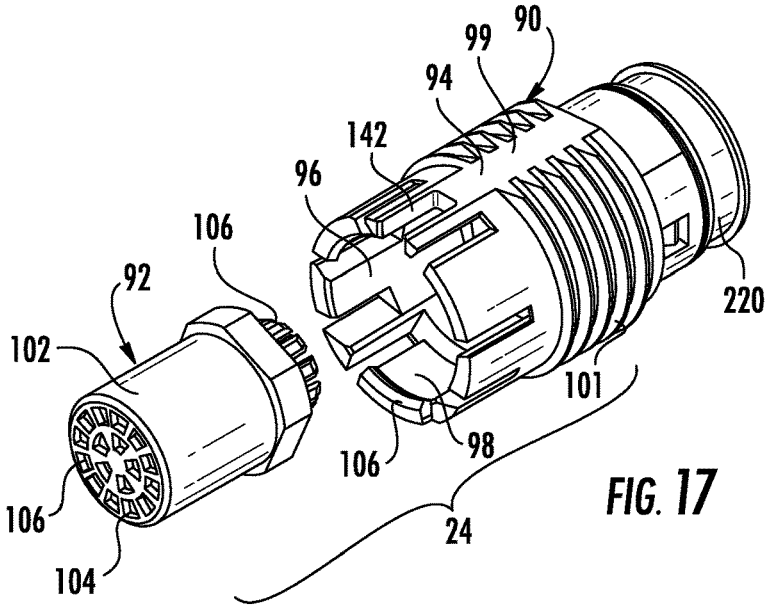
FIG. 17 is an exploded front perspective view of an embodiment of a second connector of the connector system.

As shown in FIG. 17, the second connector 24 includes a housing 90 and a terminal retainer 92.

Figure 18:
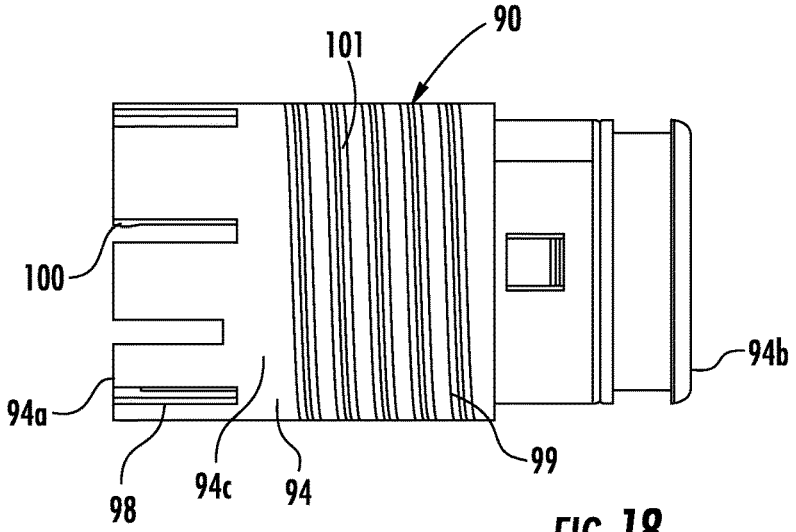
FIG. 18 is a side elevation view of an embodiment of a housing of the second connector.
Figure 19:
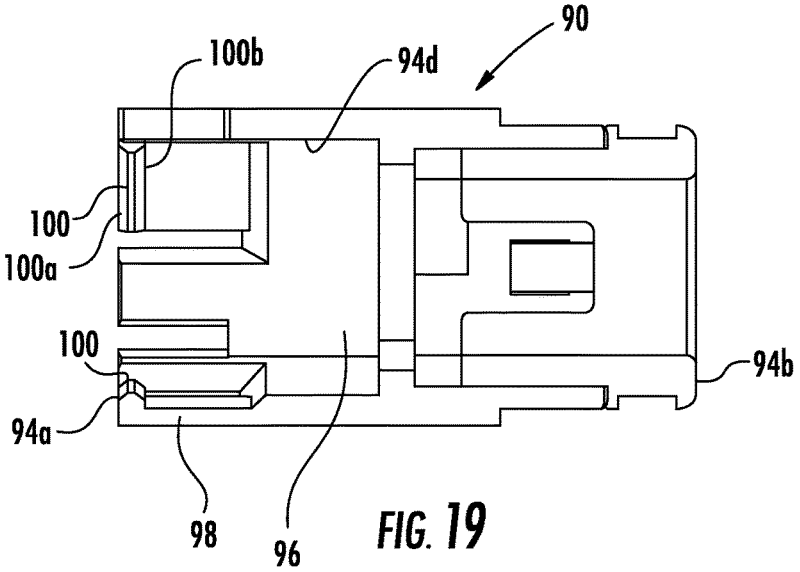
FIG. 19 is a cross-sectional view of the housing of FIG. 18.

The housing 90, see FIGS. 18 and 19, is formed from a wall 94 having a front mating end 94*a* and an opposite rear end 94*b*, an outer surface 94*c*, and an inner surface 94*d* defining a central passageway 96 which extends from the front end 94*a* to the rear end 94*b*. A plurality of spaced apart flexible fingers 98 extend from the front end 94*a* of the wall 94 to a rear portion 99 of the wall 94. In an embodiment, a thread form 101 is provided on at least a portion of the rear portion 99. At least some of the fingers 98 have a locking bump 100 extending inwardly into the passageway 96. Each locking bump 100 has a front surface 100*a* which angles inwardly from the inner surface 94*d* of the wall 94 and rearwardly toward the rear end 94*b* of the wall 94 of the housing 90, and a rear surface 100*b* which angles inwardly from the inner surface 94*d* of the wall 94 and forwardly toward the front end 94*a* of the wall 94 of the housing 90.

The terminal retainer 92, see FIG. 17, has a wall 102 defining a front end 102*a* and an opposite rear end 102*b* and an outer surface 102*c*. A plurality of passageways 104 extend through the wall 102 and respective individual terminals 106 are secured within and extends through the respective passageways 104. Respective conductors of the cable (not shown) are electrically attached to the individual terminals 106. The terminal retainer 92 is mounted within the central passageway 96 of the housing 90, and secured to, the inner surface 94*d* of the wall 94 of the housing 90.

In an embodiment, a strain relief member 106, FIG. 1, is retained to the housing 90 to provide added cable retention to the connector system 20 to provide resistance to damaging cable pullout.

In an initial, unmated (disconnected) condition, the first connector 22 and the second connector 24 are at a distance from one another. To connect the first connector 22 and the second connector 24 together, the first connector 22 is moved toward the second connector 24 in a mating direction A, see FIG. 1.

Figure 21:
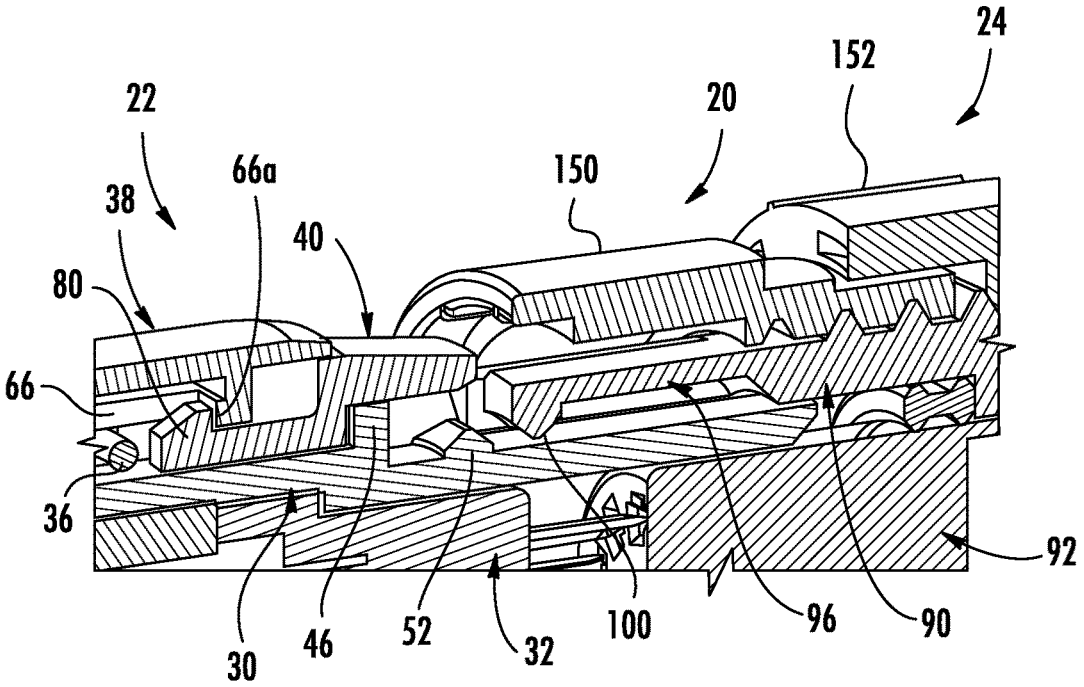
FIG. 21 is a partial perspective cross-sectional view of the first and second connectors in an initial mating condition.
Figure 22:
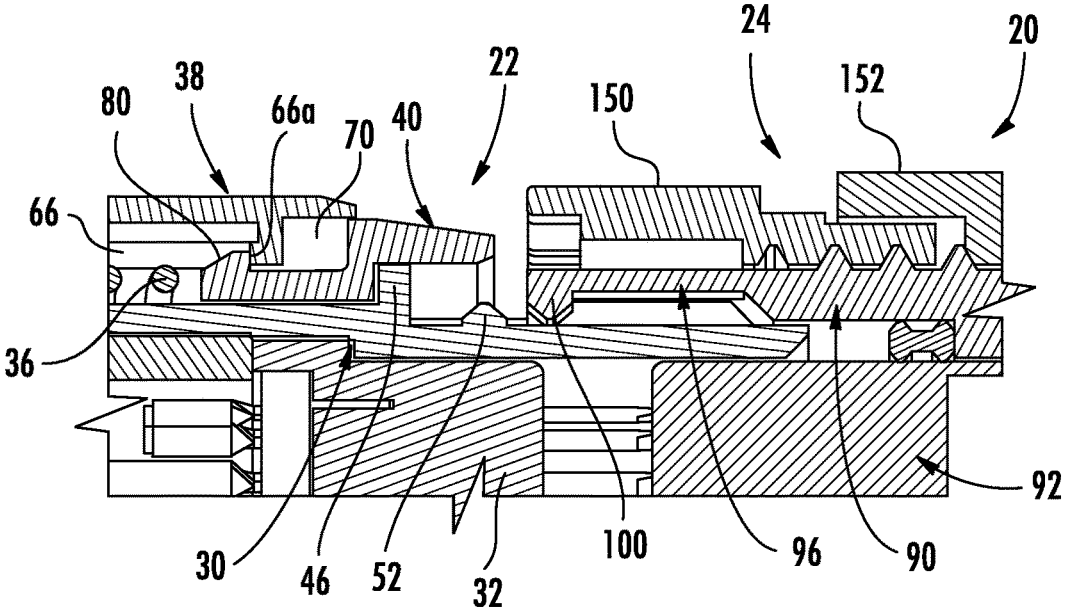
FIG. 22 is a partial cross-sectional view of the first and second connectors in the initial mating condition.
Figure 23:
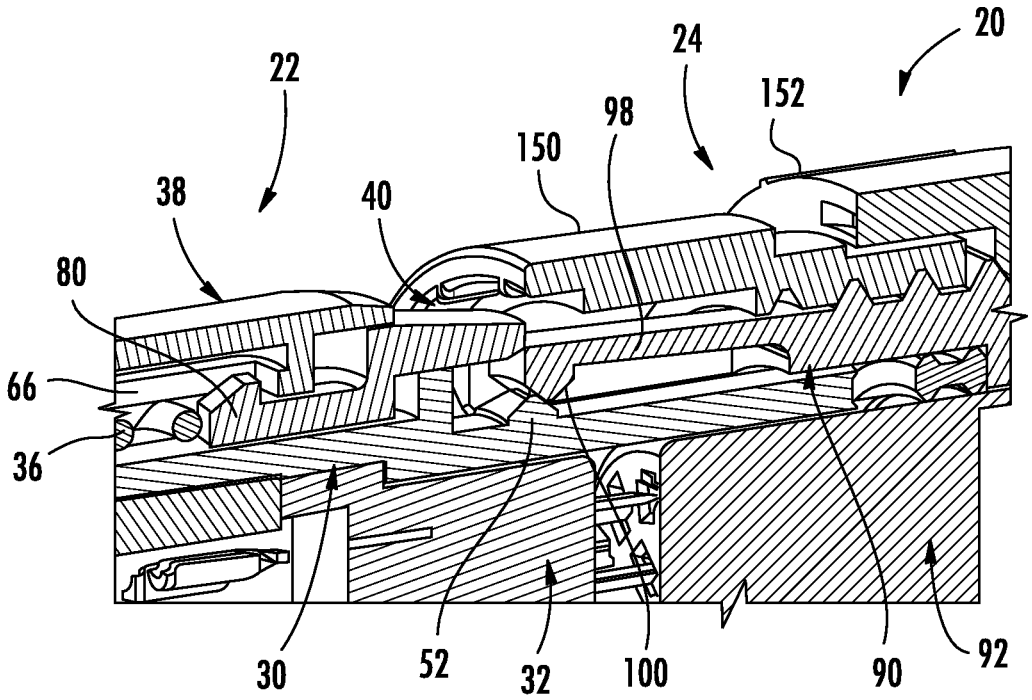
FIG. 23 is a partial perspective cross-sectional view of the first and second connectors in an intermediate mating condition.
Figure 24:
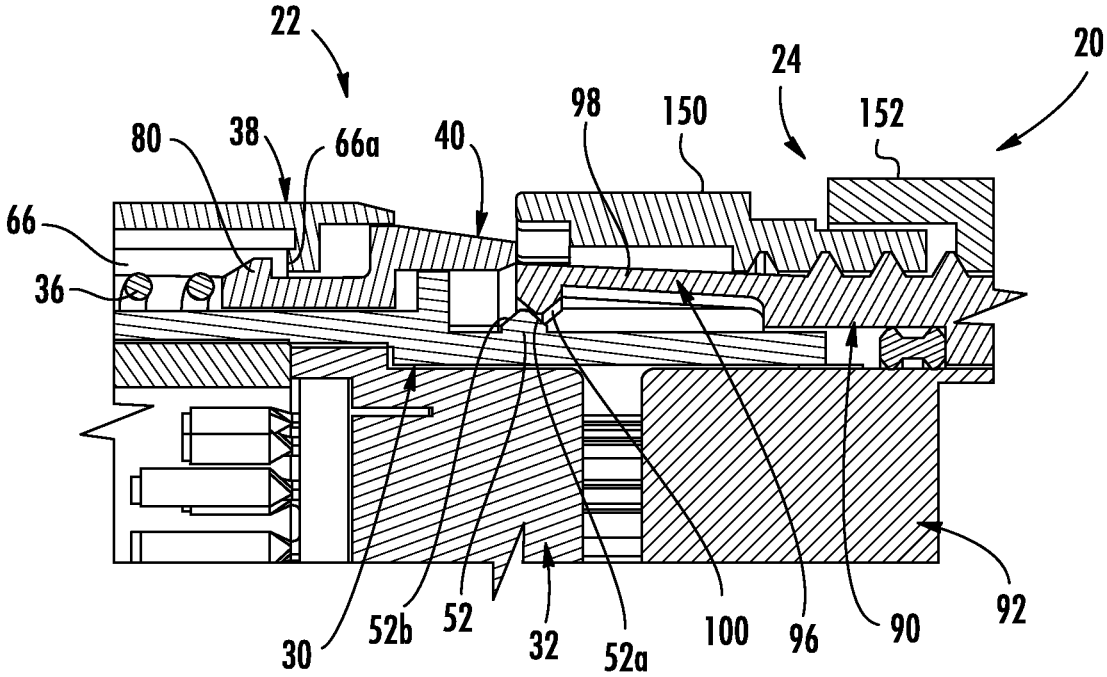
FIG. 24 is a partial cross-sectional view of the first and second connectors in the intermediate mating condition.
Figure 25:
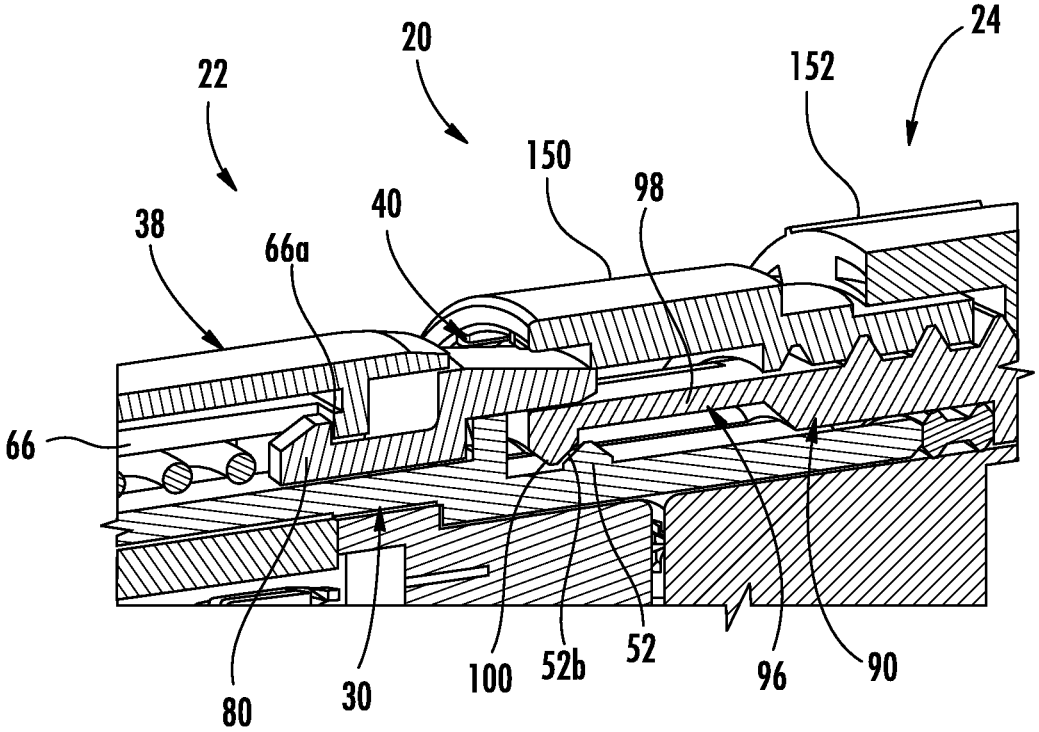
FIG. 25 is a partial perspective cross-sectional view of the first and second connectors in a final mated condition.
Figure 26:
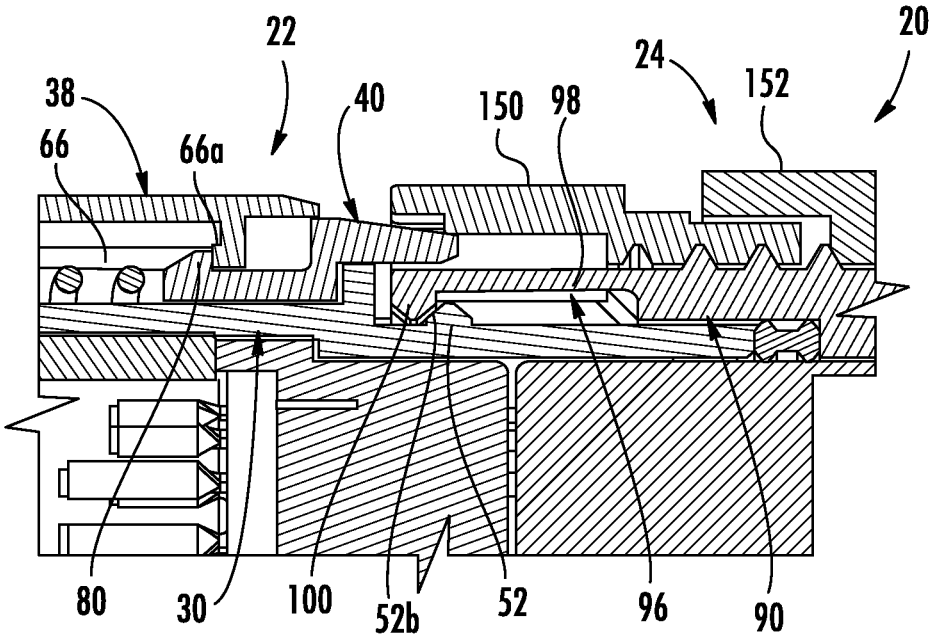
FIG. 26 is a partial cross-sectional view of the first and second connectors in the final mated condition.

When the first connector 22 is moved toward the second connector 24, the front end 42*a* of the housing 30 of the first connector 22 is pushed toward the second connector 24 and passes through the front end 94*a* of the second connector 24 and into the passageway 96 of the second connector 24, see FIGS. 21 and 22. The first connector 22 is continued to be moved toward the second connector 24 and the locking bumps 100 on the fingers 98 of the second connector 24 engage the locking protrusions 52 on the first connector 22, see FIGS. 23 and 24. The locking bumps 100 on the fingers 98 first engage the forward angled surfaces 52*a* of the locking protrusions 52 of the first connector 22 and the fingers 98 flex outwardly so that the locking bumps 100 pass over the locking protrusions 52. During this movement, the fingers 98 on the second connector 24 engage the front end 72*a* of the wall 72 of the second sleeve 40 of the first connector 22 and push the second sleeve 40 rearwardly relative to the first sleeve 38 into the second sleeve receiving spaces 70, thereby causing the projections 80 of the second sleeve 40 to slide away from the forward end 66*a* and along the recesses 66 of the first sleeve 38, and causing the biasing member 36 to compress. Once the locking bumps 100 on the fingers 98 pass over the locking protrusions 52 by sliding along the rearward angled surfaces 52*b*, the fingers 98 resume their initial unflexed position and the locking bumps 100 engage the outer surface 42*c* of the wall 42 of the housing 30 of the first connector 22. Once the locking bumps 100 have passed completely over the locking protrusions 52 on the first connector 22, the fingers 98 on the second connector 24 no longer engage the front end 72*a* of the wall 72 of the second sleeve 40 of the first connector 22, and the biasing member 36 expands to move the second sleeve 40 forwardly relative to the first sleeve 38 and at least partially out of the second sleeve receiving spaces 70, see FIGS. 25 and 26. As a result, the fingers 98 of the second connector 24 are captured between the second sleeve 40 and the housing 30 of the first connector 22, and the first and second connectors 22, 24 are now in a locked mated condition. During this movement, the terminal retainers 32, 92 engage with each other to form an electrical connection between the terminals 60, 106 of the first and second connectors 22, 24.

As a result of the construction, the first connector 22 can be inserted into the second connector 24 into the locked condition using a single hand of the user.

Figure 27:
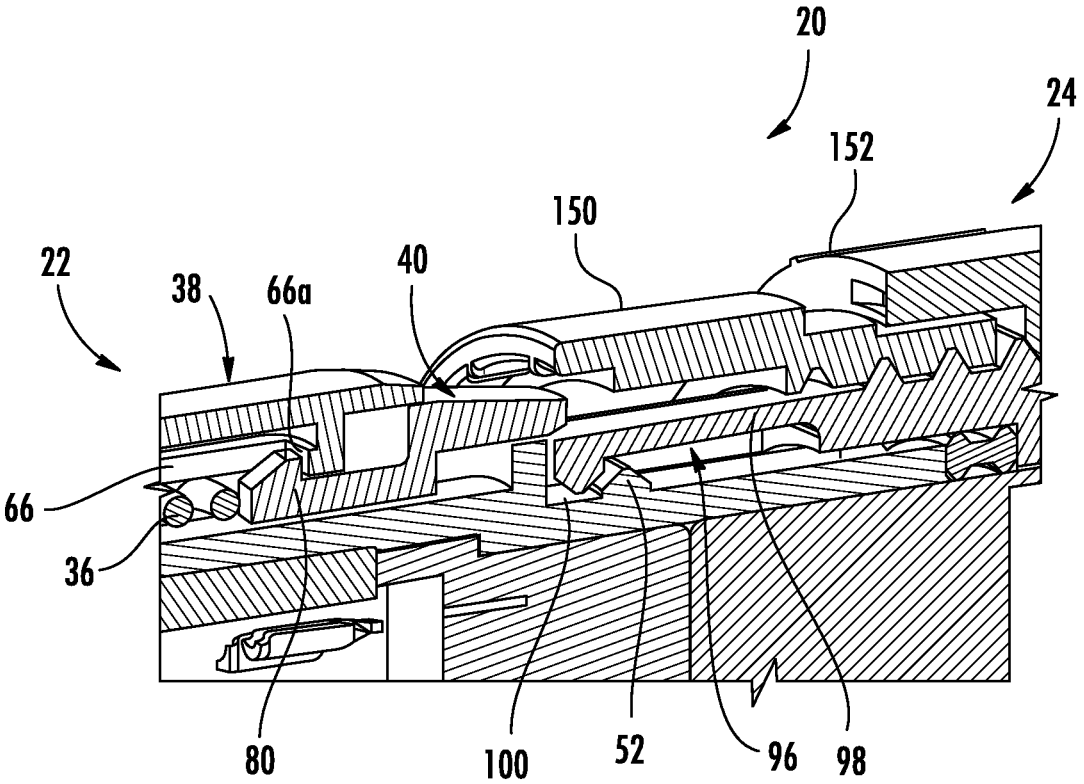
FIG. 27 is a partial perspective cross-sectional view of the first and second connectors in an initial condition for decoupling the first and second connectors.
Figure 28:
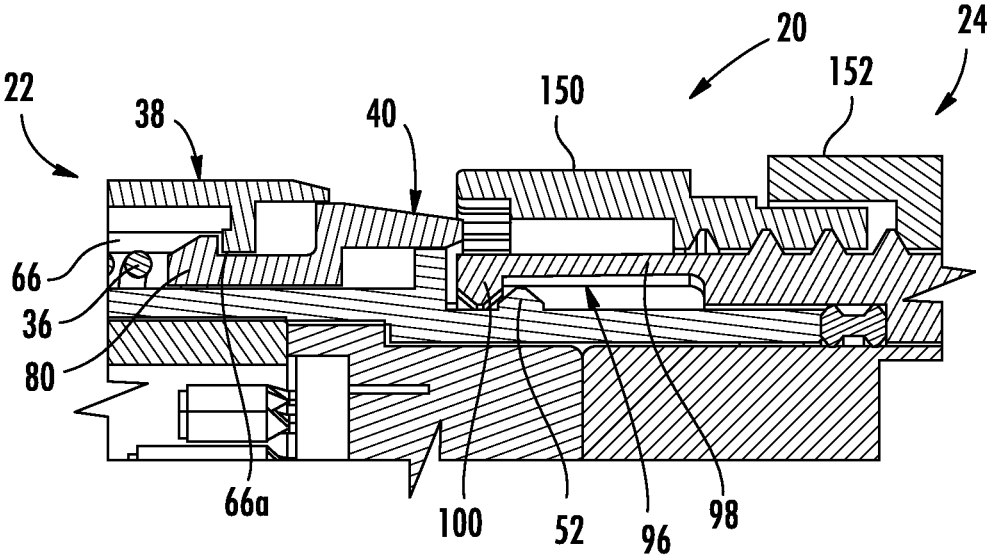
FIG. 28 is a partial cross-sectional view of the first and second connectors in the initial condition for decoupling the first and second connectors.

To detach or uncouple the first connector 22 from the second connector 24, the first sleeve 38 is grasped by a user and retracted rearwardly, see FIGS. 27 and 28. This closes the gap G and causes the second sleeve 40 to retract as a result of the engagement of the projections 80 with the forward ends 66*a* of the recesses 66 on the first sleeve 38. During this movement, the biasing member 36 is compressed between the projections 80 and the rearward flange 48 of the first connector 22 and this uncovers the fingers 98 of the second connector 24. Thereafter, the first connector 22 is pulled away from the second connector 24, thereby causing the locking bumps 100 on the fingers 98 of the second connector 24 to engage the rearward angled surfaces 52*b* of the locking protrusions 52 and pass over the locking protrusions 52. The first connector 22 can then be completely disengaged and decoupled from the second connector 24 by the continued rearward movement of the first connector 22 relative to the second connector 24. Once disengaged and decoupled, the first sleeve 38 is released and the biasing member 36 expands to move the second sleeve 40 and the first sleeve 38 forwardly to open the gap G and back to the position shown in FIGS. 21 and 22. As a result of the construction, the first connector 22 can be detached from the second connector 24 using a single hand of the user.

While the recesses 66 are shown on the inner surface 62*d* of the first sleeve 38, the recesses 66 could instead be provided on the outer surface 62*c* of the first sleeve 38 and the latch arms 76 of the second sleeve 40 would be provided on the outer surface 72*c* of the wall 72 of the second sleeve 40 to engage with the recesses 66.

Figure 29:
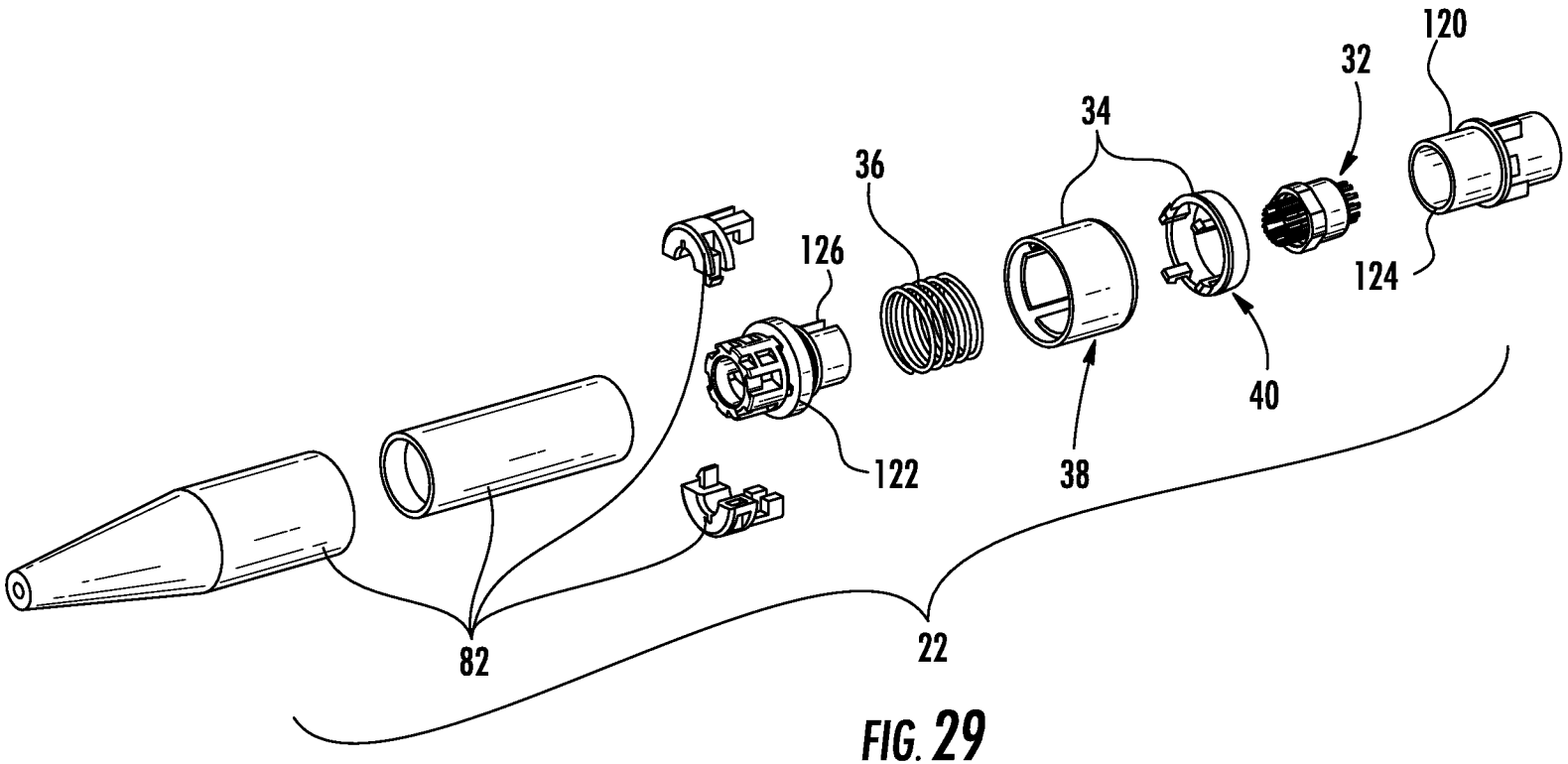
FIG. 29 is an exploded rear perspective view showing an alternate embodiment of the first connector.

In an embodiment as shown in FIG. 29, the housing 30 of the first connector 22 is formed from a front housing part 120 and a rear housing part 122 which are mated together. The terminal retainer 32 is mounted between the housing parts 120, 122. In an embodiment, the housing parts 120, 122 are mated together by a snap-fit connection. The central passageway 44 is formed in the housing parts 120, 122 such that the terminal retainer 32 is captured therein between the housing parts 120, 122. To provide the snap-fit connection, a pair of recesses 124 are provided in the inner surface of the front housing part 120 and the rear housing part 122 has a pair of flexible latch arms 126. While two recesses 124 and two latch arms 126 are shown, more than two recesses 124 and latch arms 126 may be provided. When projections on the latch arms 126 engage within the recesses 124, the housing parts 120, 122 are snap-fit together and the terminal retainer 32 is retained between the housing parts 120, 122. While the recesses 124 are described and shown as being provided on the front housing part 120 and the latch arms 126 are shown as described as being on the rear housing part 122, the recesses 124 can be provided on the rear housing part 122 and the latch arms 126 on the front housing part 120. In addition, other structures for retaining the housing parts 120, 122 together are within the scope of the present disclosure.

Figure 30:
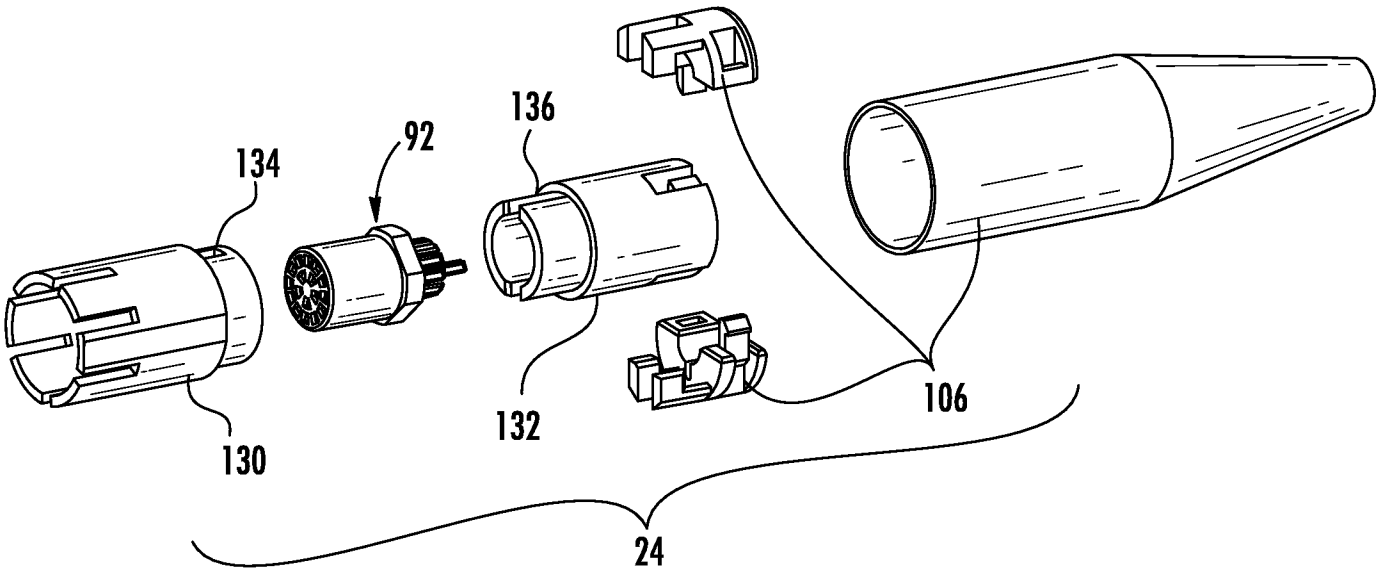
FIG. 30 is an exploded rear perspective view showing an alternate embodiment of the second connector.

In an embodiment as shown in FIG. 30, the housing 90 of the second connector 24 is formed from a front housing part 130 and a rear housing part 132 which are mated together. The terminal retainer 92 is mounted between the housing parts 130, 132. In an embodiment, the housing parts 130, 132 are mated together by a snap-fit connection. The central passageway 96 is formed in the housing parts 130, 132 such that the terminal retainer 92 is captured therein between the housing parts 130, 132. To provide the snap-fit connection, a pair of apertures or recesses 134 are provided in the inner surface of the front housing part 130 and the rear housing part 132 has a pair of flexible latch arms 136. While two apertures or recesses 134 and two latch arms 136 are shown, more than two apertures or recesses 134 and latch arms 136 may be provided. When projections on the latch arms 136 engage within the apertures or recesses 134, the housing parts 130, 132 are snap-fit together and the terminal retainer 92 is retained between the housing parts 130, 132. While the apertures or recesses 134 are described and shown as being provided on the front housing part 130 and the latch arms 136 are shown as described as being on the rear housing part 132, the apertures or recesses 134 can be provided on the rear housing part 132 and the latch arms 136 on the front housing part 130. In addition, other structures for retaining the housing parts 130, 132 together are within the scope of the present disclosure.

In an embodiment, at least one key 140, see FIGS. 3 and 4, extends outwardly from the outer surface 42*c* of the wall 42 and is provided forwardly of the forward flange 46. The at least one key 140 is inserted into respective keyways 142, see FIG. 17, between the fingers 98 of the second connector 24. One or more of the keys 140 can be eliminated.

While the components of the connectors 22, 24 are shown as having circular outer profiles, the outer profiles may take other shapes. For example, the outer profiles could be square, rectangular, star shaped, etc.

Figure 31:
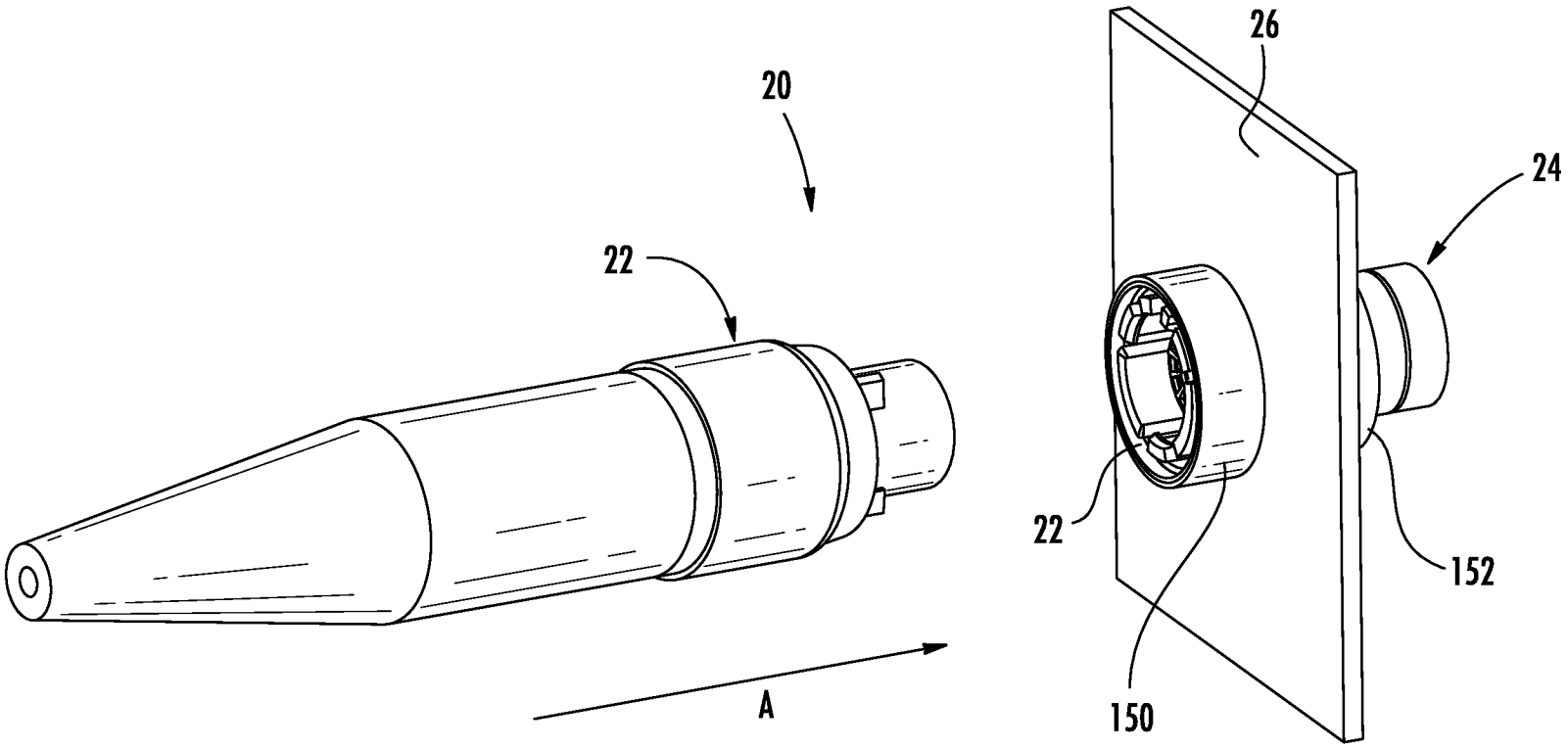
FIG. 31 is a rear perspective view showing the first and second connectors in association with a panel.

In an embodiment as shown in FIGS. 31 and 32, the second connector 24 is mounted to a panel 26 by a pair of nuts 150, 152 which threadedly mate with the thread form 101 on the outer surface 94*c* of the wall 94 of the housing 90 of the second connector 24. These nuts 150, 152 are also shown in FIGS. 21-28. It is to be understood that the second connector 24 can be used in the inline connector system or in the panel mount connector system and that the nuts 150, 152 are only shown in FIGS. 21-28 for illustration purposes. In the inline connector system, the thread form 101 can be eliminated.

Figure 33:
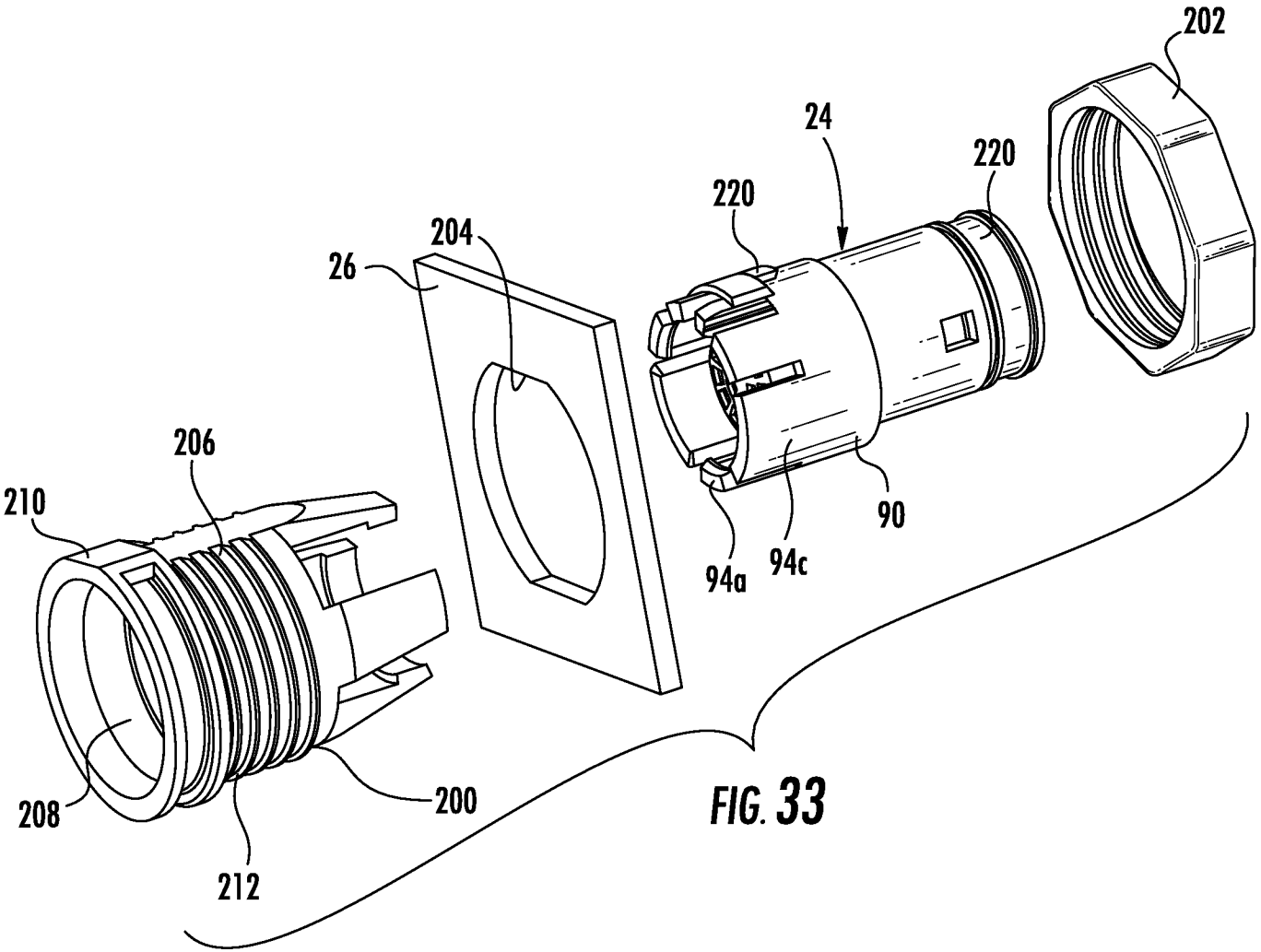
FIG. 33 is a rear perspective view showing the first and second connectors in association with an alternate panel and with an anti-rotation mount.
Figure 34:
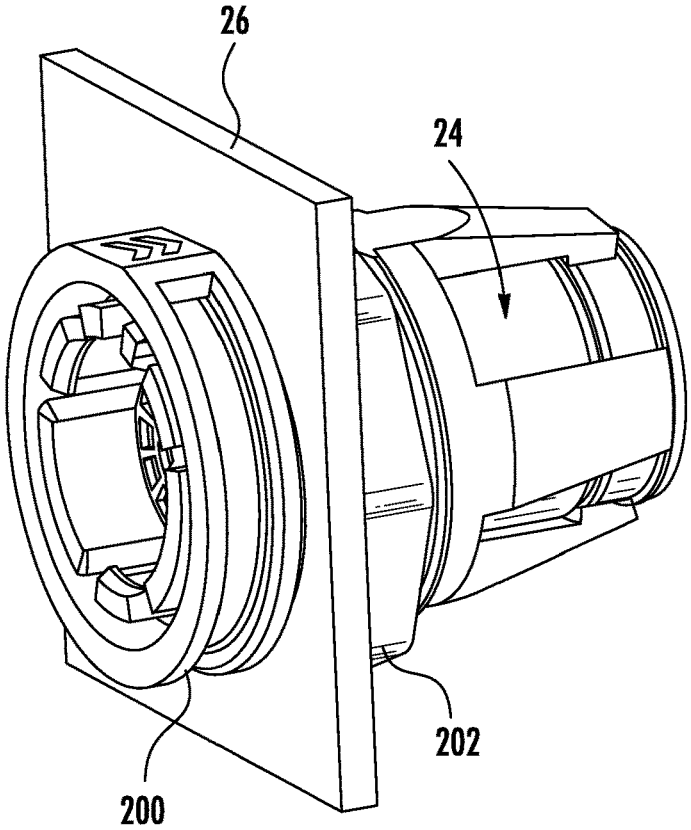
FIG. 34 is a rear perspective view showing the first connector mount to the anti-rotation mount.
Figure 35:
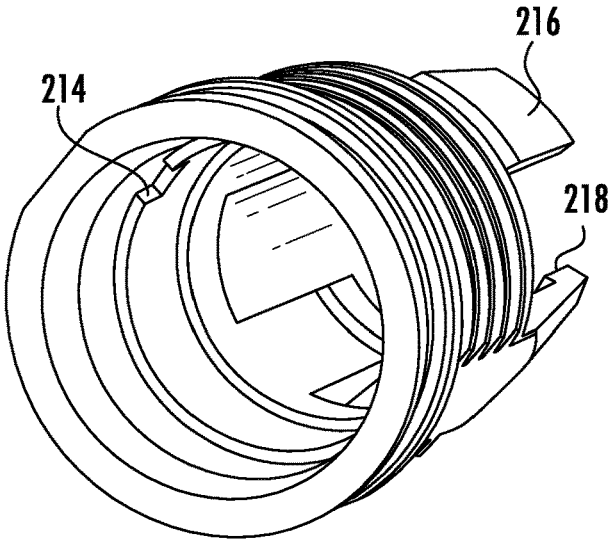
FIG. 35 is a rear perspective view of the anti-rotation mount.

In an embodiment as shown in FIGS. 33-35, an anti-rotation mount 200 and a nut 202 are provided to mount the second connector 24 in a panel 26. In this embodiment, the panel 26 has a non-circular aperture 204 therethrough. The mount 200 is formed from a wall 206 having a front end and an opposite rear end, an outer surface, and an inner surface defining a central passageway 208 which extends from the front end to the rear end. A front portion 210 of the wall 206 has a diameter which is larger than the diameter of a rear portion 212 and larger than the dimensions of the aperture 204 in the panel 26. The rear portion 212 has a non-circular profile such that when the rear portion 212 is inserted through the aperture 204, the mount 200 cannot rotate relative to the panel 26. At least a portion of the outer surface of the rear portion 212 is threaded to accept the nut 202 thereon. A keyway 214 is provided in the inner surface of the wall 206. A plurality of fingers 216 extend rearwardly from the rear portion 212 of the mount 200. Each finger 216 has a locking projection 218 thereon which extends inwardly. The housing 90 of the second connector 24 includes a key 220 on its outer surface 94*c* proximate to the front end 94*a* of the wall 94. The second connector 24 seats within the central passageway 208 and the key 220 seats within the keyway 214. This prevents the rotation of the front housing part 70 relative to the mount and the panel 26. The housing 90 of the second connector 24 includes a groove 220 in the outer surface 94*c* of the wall 94 proximate to the rear end 94*b* thereof. The locking projections 218 of the fingers 216 seat within the groove 220 to connect the mount 200 and the second connector 24 together.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

We claim:

1. A connector system comprising:

a first connector comprising a first housing having a front mating end and an opposite rear end, a first terminal retainer having a plurality of first terminals retained therein, the first terminal retainer positioned within the first housing, the first housing having a locking protrusion thereon extending from an outer surface of the first housing, a first sleeve mounted on the first housing, the first sleeve being moveable relative to the first housing, a second sleeve mounted on the first housing and attached to the first sleeve, the second sleeve being moveable relative to the first sleeve and relative to the housing, and a biasing member mounted between the first housing and the second sleeve, the biasing member configured to bias the first and second sleeves toward the front mating end; and a second connector configured to be connected to the first connector, the second connector including a second housing having a front mating end and an opposite rear end, a second terminal retainer having a plurality of second terminals retained therein configured to mate with the first terminals, the second terminal retainer positioned within the second housing, the second housing having a flexible finger at the front mating end thereof, the flexible finger configured to cause movement of the second sleeve relative to the first sleeve and further configured to releasably engage the locking protrusion on the first housing.

2. The connector system of claim 1, wherein the biasing member is a coil spring.

3. The connector system of claim 1, wherein the locking protrusion has a first angled surface and a second angled surface.

4. The connector system of claim 1, wherein one of the first and second housings has a key on an outer surface and the other of the first and second housings has a keyway on its outer surface into which the key seats when the first and second connectors are mated together.

5. The connector system of claim 1, wherein the first and second housings have outer circular profiles.

6. The connector system of claim 1, wherein a plurality of flexible fingers and locking protrusions are provided.

7. The connector system of claim 6, wherein each locking protrusion has a first angled surface and a second angled surface.

8. The connector system of claim 1, wherein the second housing has a thread form on its outer surface.

9. The connector system of claim 8, further comprising a nut threadedly attached to the thread form on the second housing.

10. The connector system of claim 1, further comprising a mount for mounting the second connector to a panel.

11. The connector system of claim 10, wherein an outer surface of the mount is non-circular.

12. The connector system of claim 11, further comprising a panel into which the mount is attached, the panel having a non-circular aperture into which the mount is seated.

13. The connector system of claim 1, wherein the second sleeve includes a flexible arm having a projection at a free end thereof, and the first sleeve includes an elongated recess into which the projection of the second sleeve engages, the projection being slidable along the elongated recess.

14. The connector system of claim 13, wherein the elongated recess of the first sleeve is on an interior surface thereof.

15. The connector system of claim 13, wherein a plurality of flexible arms and recesses are provided.

16. The connector system of claim 13, wherein the elongated recesses of the first sleeve are on an interior surface thereof.

* * * * *